US005501095A

United States Patent [19]

Dilger et al.

[11] Patent Number: 5,501,095

[45] Date of Patent: Mar. 26, 1996

[54] BENDING PRESS

[75] Inventors: Werner Dilger, Leonberg; Friedrich Kilian, Göppingen, both of Germany

[73] Assignee: Trumpf GmbH & Co., Ditzingen, Germany

[21] Appl. No.: 319,813

[22] Filed: Oct. 7, 1994

[30] Foreign Application Priority Data

Oct. 8, 1993 [DE] Germany ..... 9315209.4 U

[51] Int. Cl.[6] ..... B21D 11/22

[52] U.S. Cl. ..... 72/461; 72/389.3; 72/31.1

[58] Field of Search ..... 72/461, 389, 36

[56] References Cited

U.S. PATENT DOCUMENTS

| | | | |
|---|---|---|---|
| 4,089,200 | 5/1978 | Wingate et al. . | |
| 4,411,150 | 10/1983 | Klein et al. | 72/461 |
| 4,494,312 | 1/1985 | Roch . | |
| 5,203,198 | 4/1993 | Stursberg | 72/461 |

FOREIGN PATENT DOCUMENTS

| | | | |
|---|---|---|---|
| 0102852 | 9/1983 | European Pat. Off. . | |
| 3739949 | 3/1989 | Germany . | |
| 3148744 | 3/1989 | Germany . | |
| 221226 | 9/1991 | Japan | 72/461 |
| 190924 | 7/1992 | Japan | 72/461 |

OTHER PUBLICATIONS

Patent Abstracts of Japan: vol. 6, No. 187 (M–158) 25 Sep. 1982 and JP–A57 094 428 (Yamaha Yoshiyuki) *Abstract*.

*Primary Examiner*—David Jones
*Attorney, Agent, or Firm*—Pepe & Hazard

[57] ABSTRACT

A bending press has a drive mechanism for effecting vertical movement of a bending tool in a bending line, a drive actuating device, and a locking mechanism for the actuating device. A stop assembly behind the bending line includes a rail, a rail drive mechanism to move the rail perpendicularly to the bending line, and at least two stops on said rail. A releasable clamping mechanism fixes the stops in position on the rail, and the stops are movable along the rail upon release of the clamping mechanism. A clamp locking mechanism locks the clamping mechanism in a clamp fixing position. The stop assembly is movable into a position in which the stops project over the bending line when the drive locking mechanism is actuated, and the clamp locking mechanism is actuatable to release the clamp locking mechanism when the drive locking mechanism is actuated.

16 Claims, 6 Drawing Sheets

228, 229
R
X
24
17
37
40
39
28,29
228, 229
428
128, 129
23
V
328, 329
329,
328
38

BENDING PRESS

BACKGROUND OF THE INVENTION

The present invention is related to bending presses and, more particularly, to bending presses for the forming of workpieces in which stops for the workpiece may be moved along a positioning rail.

Bending presses are known to come in many different designs. Usually every bending press has a rear stop against which the workpiece to be edged is placed before the bending operation, so that the edge is made in precisely the right place. These rear stops can be adjusted on the X-axis, i.e., in the plane of the workpiece and perpendicular to the bending line, and can be adjusted in the R-axis, i.e., perpendicular to the plane of the workpiece. This adjustment must be made manually on many presses and is done on other bending presses by drive motor or a mechanism which may be a pneumatically or hydraulically operated piston. Some bending presses also have a front stop and, possibly, side stops by which the position of the workpiece in the work area can be precisely determined and, when necessary, changed.

The rear stops in most machines are either a one piece stop strip or several individual stops spaced apart along a support. Here again, both the stop strip and the individual stops can be adjusted in position either manually or by means of a drive mechanism for this purpose. It is also known that when the rear stop is in the form of several individual stops, the individual stops can be disposed along the Z-axis, i.e., in the direction of the bending line. Moreover, the distance between the individual stops can be changed either manually or with an appropriate drive mechanism.

With regard to bending presses, it is also known that the drive for the vertical movement of the bending tool is actuated by a hydraulic device. When the bending tool is in its resting position, then the control mechanism device is locked by a mechanism that prevents it from being unintentionally switched ON until the operator consciously deactivates it, so that only then does the lift actuating device activate the drive. In this way, any unintentional activation of the lift actuating device will be prevented.

In simple bending presses, the individual stops are usually positioned manually. However, to do this, the operator must reach from his work area over the bending line to the stop area. This is awkward on the one hand, and not without danger on the other hand.

It is an object of the present invention is to improve a novel bending press in which the position of the stops may be adjusted manually without danger.

It is also an object to provide such a bending press which may be fabricated readily and relatively economically.

Another object is to provide such a bending press in which the stops are firmly clamped during machine operations and readily movable when operation is disabled.

Further advantages, features and details of the invention can be seen in stem from the following description in which, with reference to the drawing, a particularly preferred example of embodiment is illustrated in detail.

SUMMARY OF THE INVENTION

It has now been found that the foregoing and related objects may be readily attained in a bending press for bending workpieces along a bending line and providing a work area in front of the bending line and a stop area behind the bending line, including a drive mechanism for effecting vertical movement of a bending tool in the bending line, an actuating device for the drive mechanism, and a locking mechanism for the actuating device. A stop assembly is provided in the stop area and includes a rail, a rail drive mechanism to move the rail perpendicularly to the bending line, and at least two stops on the rail. The stop assembly also includes a releasable clamping mechanism to fix the stops in position on the rail, and the stops being movable along the rail upon release of the clamping mechanism.

A clamp locking mechanism is provided for locking the clamping mechanism in a clamp fixing position. The stop assembly is movable into a position in which the stops project over the bending line into the work area of the bending press when the drive locking mechanism is actuated, and the clamp locking mechanism is actuatable to release the clamp locking mechanism when the drive locking mechanism is actuated.

Generally, the clamping mechanism includes a clamp which, when actuated, clamps the stop to the rail, and at least one component which, when actuated, presses against the rail and stop. This one component may be actuated by a source of compressed air or by an electromagnet.

Desirably, the clamp can be changed in its position about the rail by a fluid mechanism.

In one embodiment, the component includes an expansible element which, when filled with fluid, expands. In another embodiment, the clamping mechanism utilizes electrical power and the clamp locking mechanism includes a switch which interrupts the flow of electricity to release the clamping mechanism. Desirably, the clamp locking mechanism includes a release mechanism to release the clamping mechanism and the locking mechanism deactivates the release mechanism.

Preferably, the drive actuating device locking mechanism includes a switch which interrupts the flow of electricity to the drive actuating device.

DETAILED DESCRIPTION OF THE PREFERRED EMBODIMENT

Figure 2:
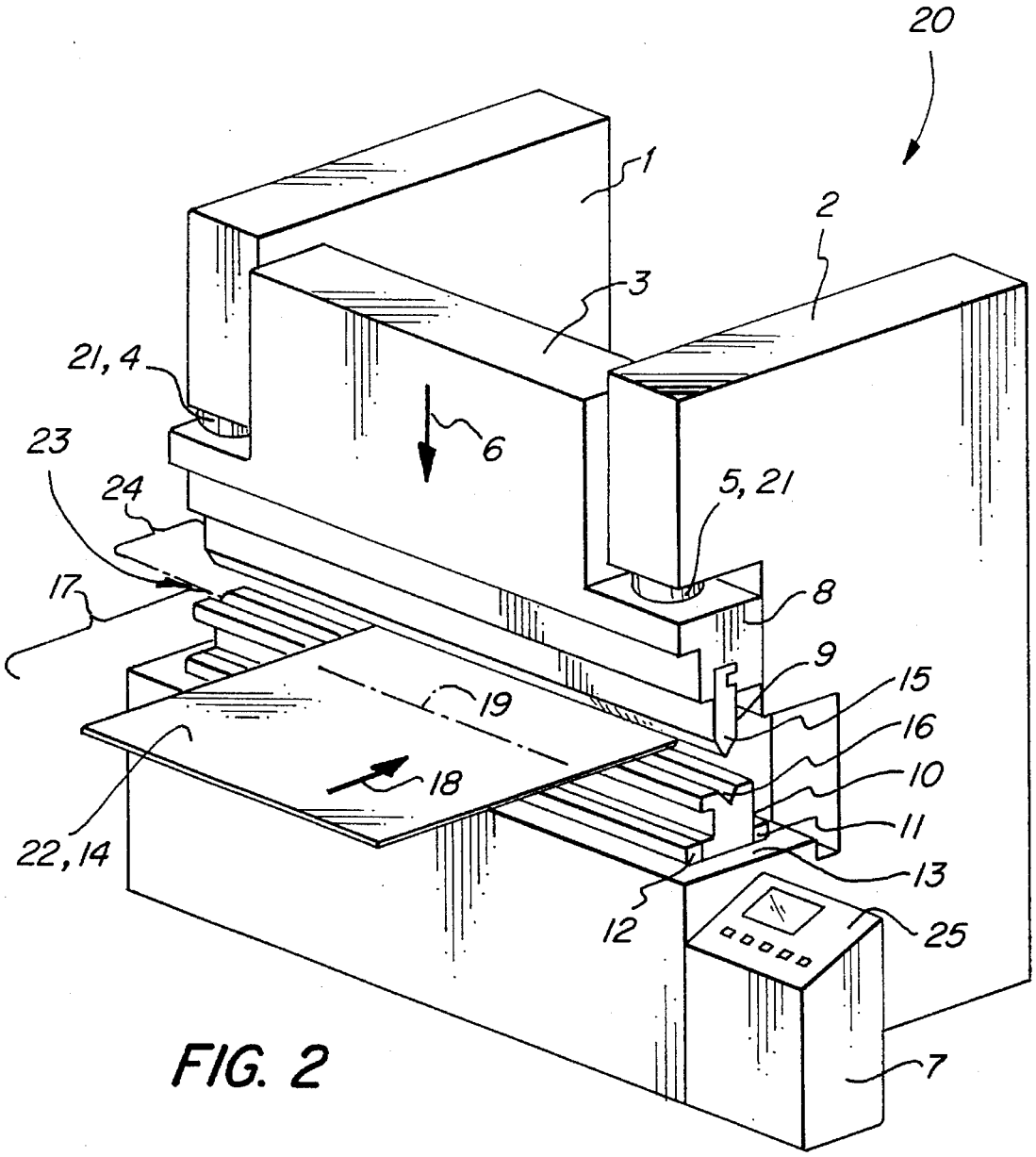
FIG. 2 is a perspective view of a prior art bending press.

Turning first to FIG. 2, this is a representation of an existing design of bending press, in particular, a perpendicular bending press whose design is known. This bending press, which as a whole is designated by 20, shows a frame which includes by way of example two stands, 1 and 2, on which there is a top clamping bar 3. Press cylinders 4 and 5, which work as a drive 21, move the top clamping bar 3 in the direction of the arrow 6 downwardly and in the opposite direction upwardly. At least this lifting movement of the bending press 20 is actuated and controlled by a lift actuating device 7. A holder 8 for a bending tool 9, e.g., a bending stamp that works with a bending die 10, is found on the top clamping bar 3. The bending tool 9, as shown in FIG. 2, is basically shaped like a bar. The bending die 10 is correspondingly bar shaped, and it is securely held to the bed 13 of the bending press 20 by means of appropriate die holders 11 and 12 shown only schematically. FIG. 2 also shows a metal sheet 14 as the workpiece 22 which is being pushed in the direction of arrow 18 into the bending press 20 up to the line marked 19 which is aligned with bending line 23. When the workpiece 22 is in this position, then the bending tool 9 with its die 15 lies above line 19, and the die 10 with its V-shaped notch 16 lies below line 19. The space in front of bending line 23 is defined as work area 17, and that behind bending line 23 is defined as the stop area 24. The operator, who guides the workpiece 22 and inputs commands into a control console 25, usually stands in the working area 17. The control console 25 also has a switch locking mechanism which, when actuated, locks the lift actuating device 7 so that the drive 21 and the press cylinders 4 cannot be actuated. The top clamping bar 3 is then locked in the position shown in FIG. 2.

Figure 3:
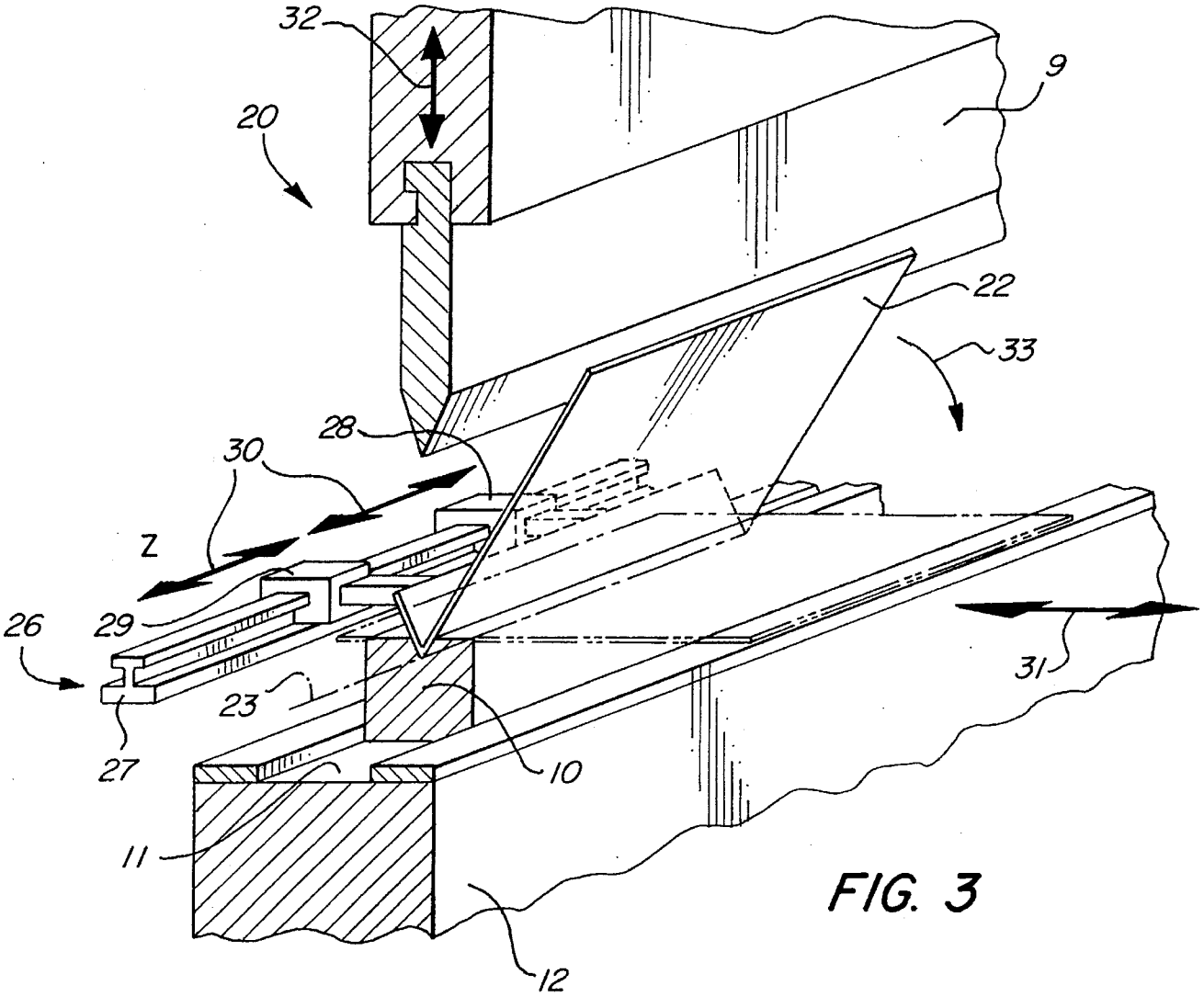
FIG. 3 is a fragmentary perspective view of another type of prior art bending press.

The bending press 20 shown in FIG. 2 has a stop device 26 designed as a rear stop, which is not shown in FIG. 2, but is shown in the existing bending press 20 illustrated in FIG. 3.

This stop device 26 shown in FIG. 3 consists basically of a rail 27 on which two stops 28 and 29 are arranged. These stops 28 and 29 can be moved on the rail 27 in the direction of arrow 30 showing the Z-direction. The stops 28 and 29 extend towards the bending line 23 and have end surfaces which position the rear edge of the workpiece 22 which is in the stop area 24. In this way, the position of workpiece 22 can be determined in the direction of the X-axis (arrow 31). When the workpiece 22 is properly positioned, the switch locking device is deactivated to release the lift actuating device 7. When actuated, the bending tool 9 moves vertically in the direction of the double arrow 32. The workpiece 22 is bent along the bending line 23 and takes the position represented by the line passing through it. When the bending tool 9 is moved away from the bending die 19, the workpiece 22 falls back in the direction of arrow 33 onto a layout table which is not shown.

Figure 1:
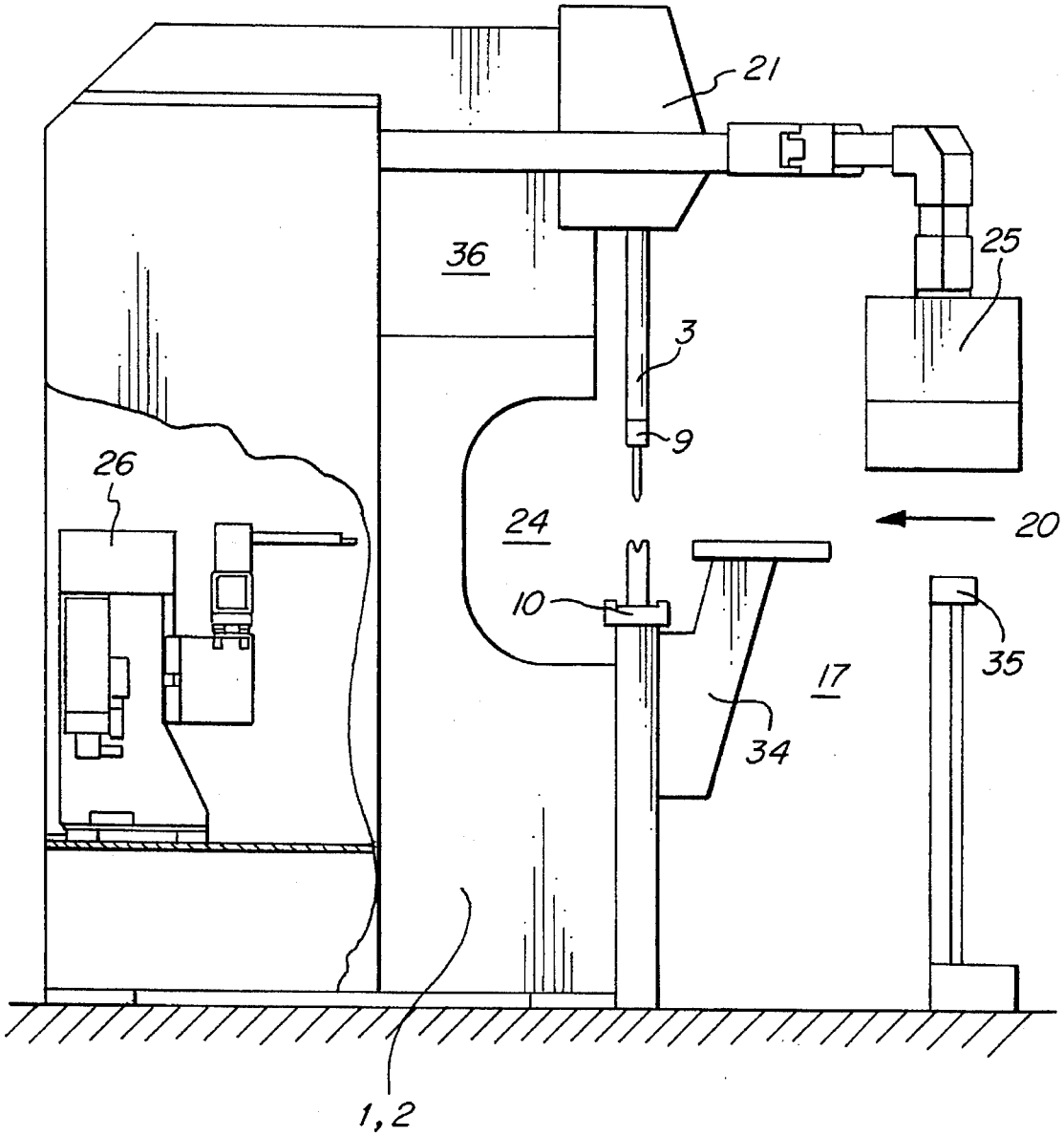
FIG. 1 is a partially diagrammatic side elevational view of an bending press embodying the present invention with a portion of the housing broken away to reveal internal construction.

FIG. 1 shows a preferred embodiment of a bending press 20 in the invention with its individual components. In the work area 17 there is a support table 34 for the workpiece 22 which, for the sale of clarity, is not shown here. Underneath the control console 25, there are two hand operated controls 35 by which the lift actuating device 7 can be actuated. Above the stop area 24, there is a hydraulic or electric drive system 36 for the drive 21 for the top clamping bar 3 and the bending tool 9. As seen, the stop device 26 has been moved completely out of the stop area 24 toward the rear (to the left in FIG. 1).

Figure 4:
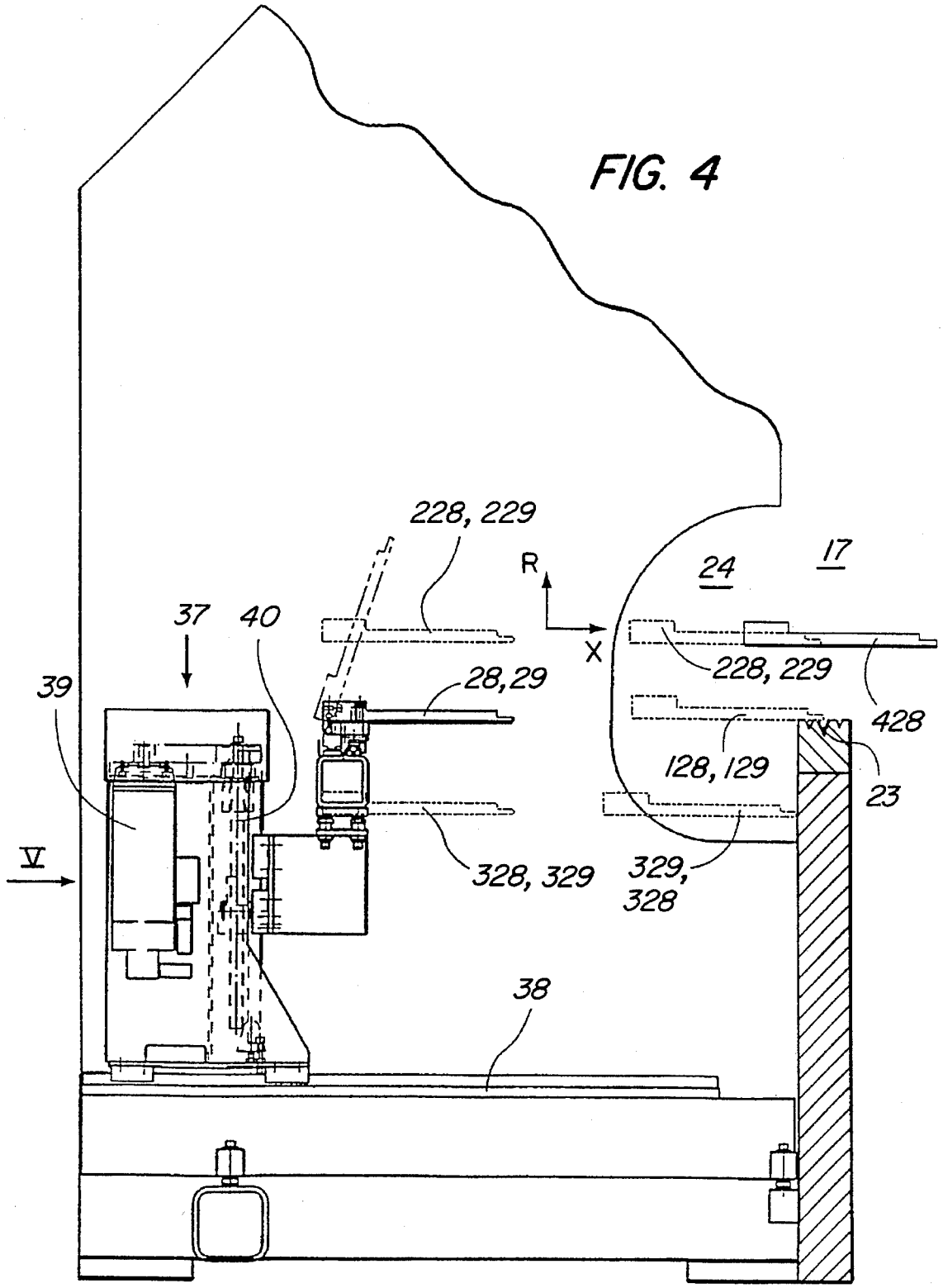
FIG. 4 is a cross sectional view of the bending press of FIG. 1.
Figure 5:
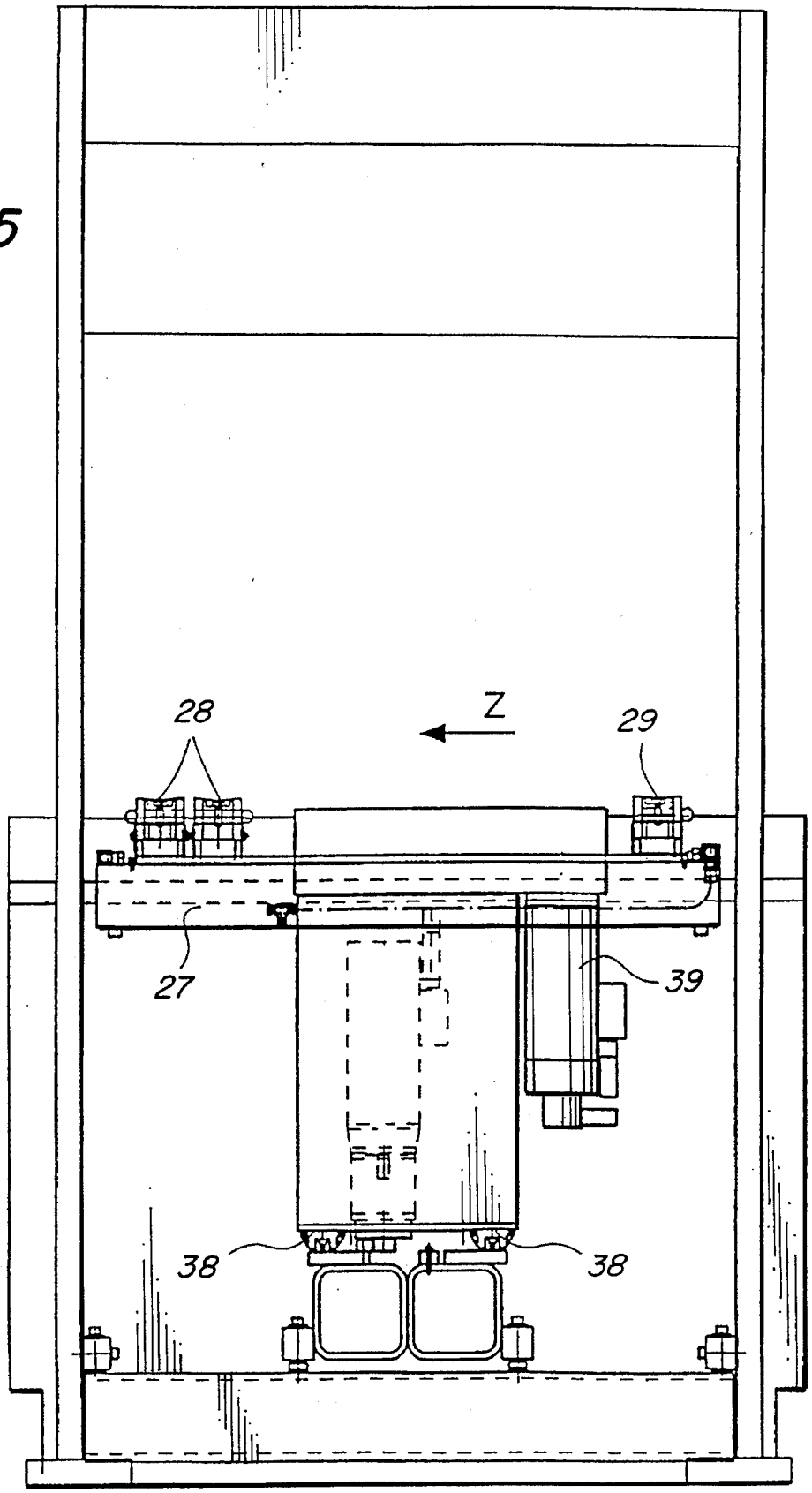
FIG. 5 is a cross sectional view in the direction of the arrow V in FIG. 4.

In FIGS. 4 and 5, the stop device 26 is shown enlarged and in several positions in phantom and dotted line. The stop device 26 has a slide member 37 which runs on rails 38 extending in the X-direction, i.e., perpendicular to bending line 23. In this way the stops 28, 29 can be moved toward the workpiece 22 (not shown) i.e., in the direction of the bending line 23. In FIG. 4, the stops 28, 29 are shown in their initial position, in which they have been moved all the way back, i.e., at the farthest distance from the bending line 23. In the position of the stops designated by the numerals 128 and 129, they have been moved so far forwardly into the stop area 24 that they almost touch the bending line 23. The stops designated by the numerals 228 and 229 show the position in which they have been moved upwardly, i.e., in the R-direction, by a vertical drive 39 which moves a spindle 40. The stops designated by the numerals 328 and 329, which are only incompletely shown, have also been shifted along the R-axis, but downwardly.

Figure 6:
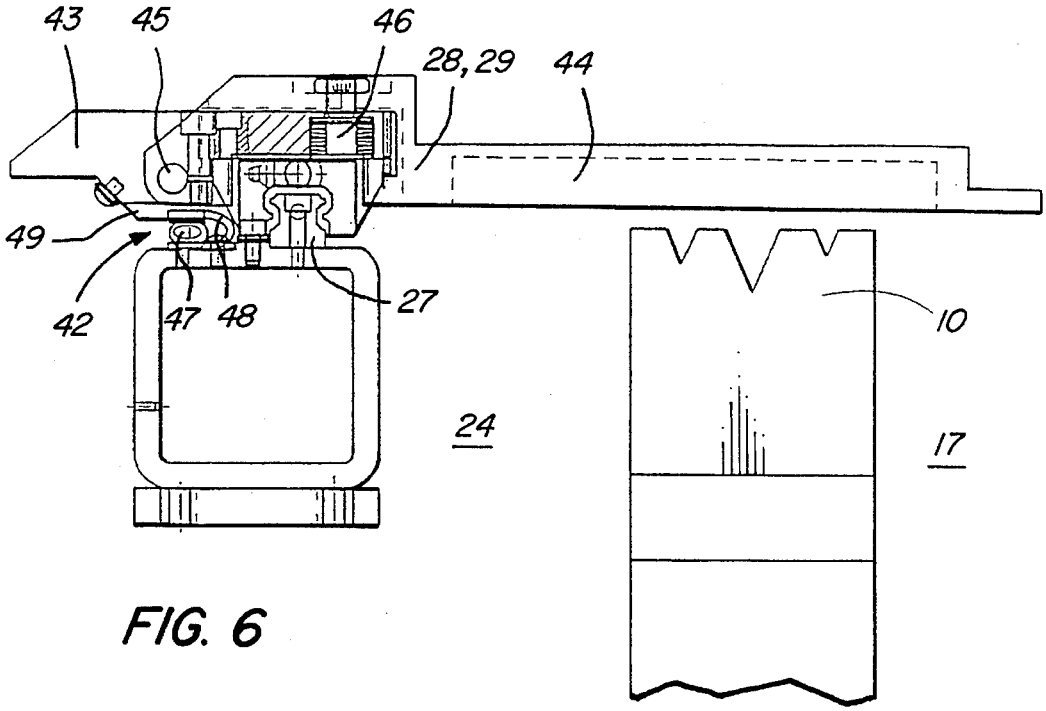
FIG. 6 is a cross sectional view of a stop advanced to the changing position.
Figure 7:
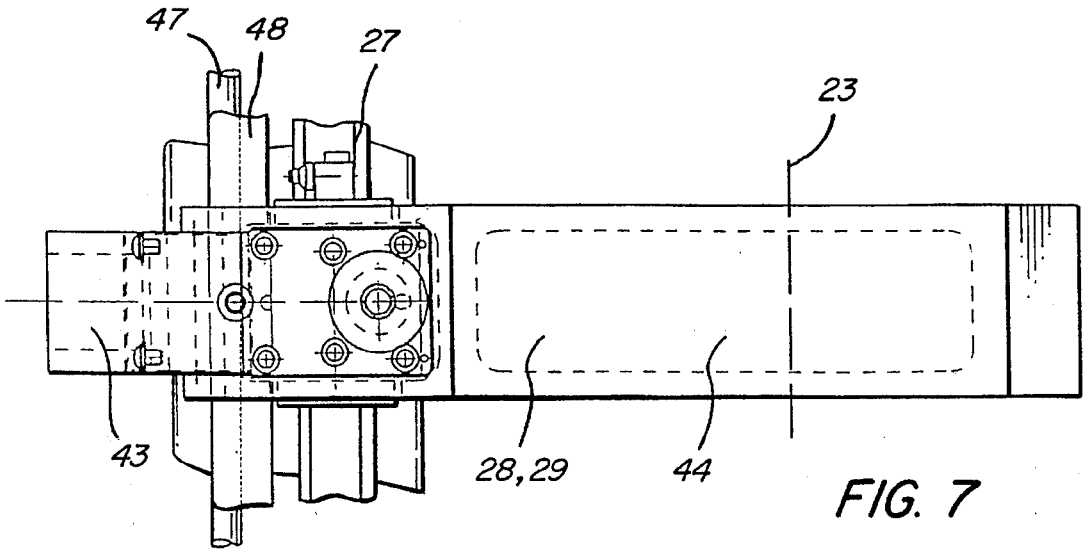
FIG. 7 is a fragmentary top plan view of a stop and support assembly.

Outside the stop area 24, i.e., in the working area 17, another stop marked 428 is shown. This position is taken by stop 428 when it must be repositioned by the operator along the Z-axis (see FIG. 5). For this adjustment, the top clamping bar 3 is in its highest position and the lift actuating device 7 is locked by means of the switch locking mechanism, so that even if the two hand controls 35 are actuated at the wrong time, no vertical position of the top damping bar 3 can take place. The stops 28, 29 are mounted on a rail 27 so that they can be repositioned when they are in the position indicated by the reference numeral 428. This is done manually in this embodiment. To enable such repositioning, the stops 28, 29 are attached to the rail 27 by means of a clamping device 42, shown in FIG. 6. FIG. 6 also shows that the stops 28, 29 consist of a part 43 which touches and holds the rail 27 and an outer swivelling part 44, which is coupled to the holding part 43 at the joint 45. In the at rest position shown in FIG. 6, the part 44 is in a horizontal position. Under the pressure of an expansible component 46, the part 44 is swivelled upwardly, as illustrated in phantom line in FIG. 4.

When the stops 28, 29 are in the desired position on the rail 27, then the latter is held by the clamping device 42. A pressure hose 47 is provided for this purpose, and is disposed in a basically C-shaped profile section 48. A spring component 49, which is fastened to the holder 43 of the stop 28, for example with a screw and which moves along the rail 27, acts between the pressure hose 47 and the upper leg of the profile section 48. The pressure hose 47, the profile section 48 and the spring component 49 make up the clamping assembly which locks stops 28 to the rail 27. In doing this, compressed air is supplied to the hose 47 so that it inflates and clamps the spring component 49 between itself and the profile section 48. In this way, the stop 28 is fixed in position. The release of the compressed air from the hose 47 is controlled by a release valve which is not shown. This release has a locking witch that actuates or deactivates it. If the stop 28 is in the position shown in FIG. 6 in which it extends beyond the bending line 23, then the locking mechanism is deactivated so that compressed air can be exhausted from the compressed air hose 47 via the release valve and thereby the clamping action can be terminated. In this way, the stop 28 can be moved on the rail 27 to the desired position. While this is taking place, as mentioned above, the lift actuating device 7 for the top clamping bar 3 is locked by the switch locking mechanism.

When the stop 28 is moved back from the position shown in FIG. 6 into the stop area 24, then the locking mechanism for the release valve may activated, so that, after the stop 28 is clamped in the desired position, air from the pressure hose 47 can no longer be released. The stop 28 can therefore only be moved on rail 27 to a position in which it reaches over bending line 23, whereby the clamping mechanism 42 can be released, so that the spring component 49 can be moved between pressure hose 47 and the profile section 48.

As can be seen, the present invention includes a locking device to release the clamping mechanism, and the stop mechanism is able to travel to a position in which the stops move forward across the bending line into the working area of the bending press, when the switch locking mechanism is activated and the locking mechanism for the clamping device is not activated.

In bending presses according to the invention, the bending tool is therefore in the at rest position and the actuating device for the drive is locked by a locking mechanism for the switch which is switched ON or activated. With the bending tool in this position, the stops can be moved out of the strike area across the bending line into the work area where the operator then has easier access. The greatest advantage is that the operator no longer has to reach across the bending line into the stop area to move the individual stops. Thus, in a bending press which embodies the invention, the individual stops can be moved manually without any danger. Since the switch locking mechanism for the drive actuating device assembly is activated, there is no danger that the bending tool will move vertically so as to cause risk or damage.

A further substantial advantage of the invention is that, with the stops passing over the bending line into the work area, the locking mechanism for releasing the clamping device of the stops is inactive. Only in this position can the individual stops be moved. As soon as the adjusted and tightly clamped stops leave this position again, the locking mechanism is activated, so that the clamping device can no longer be released. A bending press like this can also be operated quickly and safely by unskilled help, requiring a minimum of operator skill because the stops can be adjusted manually. This means that no changes in the machine's programming need to be made.

Another version of the bending press of the invention is one in which the clamping device includes a clamp which, when activated, clamps the stops to the rail. Such a clamp is permanently activated and is only deactivated when the stops move past the bending line and when the actuating device which drives the bending tool is locked by the switch locking mechanism. Clamping the stops to the rail also ensures that each individual stops executes a feed movement on the rail.

In one preferred embodiment of the invention, the clamp has an element or corresponding section which, when activated, presses against both the rail and the stops. This makes it simple to clamp the stops to the rail.

According to one form or embodiment, the clamp can be actuated by an expansible member, an electromagnet, or the like. The air in the expansible member is either filled with compressed air or exhausted, so that a high degree of safety is achieved in that the expansible member containing compressed air is preloaded, e.g., by the force of a pressure spring, to produce the clamping action, so that the expansible member exhausts under pressure. This can also be the case with a electromagnet, which releases the clamping action when a voltage is applied.

Moreover, the clamp can be actuated by a fluid to assume various positions and/or forms. The fluid can be a gas or a liquid. To change the position, for example, a wedge can be used.

In one preferred embodiment, the clamp utilizes an expansible member which can be filled with a fluid, such as air and with a cross section and/or position which can be changed by internal pressure. In this way, the clamping action can be brought about by introducing compressed air or a hydraulic fluid.

The drive locking device may have a switch which interrupts electrical current to the drive actuating device. This switch is usually permanently turned ON and must be consciously turned OFF to feed electricity to the drive actuating device.

The clamp locking mechanism to release the clamp may include a switch which interrupts the current to release the clamping mechanism. Here again, the switch is permanently set to interrupt the supply of electricity, and that setting is changed only when, as mentioned earlier, the stops go over the bending line and the drive locking mechanism for the drive actuating device is activated.

The present invention also provides a release mechanism to release the clamping device, in which the locking mechanism deactivates the release mechanism. In this embodiment, however, the clamping mechanism must not be released manually. The stops can be moved manually as soon as the locking device is deactivated.

Having thus described the invention, what is claimed is:

1. A bending press for bending workpieces along a bending line and providing a work area in front of the bending line and a stop area behind the bending line, said press comprising:

(a) a drive mechanism for effecting vertical movement of a bending tool in said bending line;

(b) an actuating device for said drive mechanism;

(c) a locking mechanism for said actuating device to disable its operation;

(d) a stop assembly in the stop area and including:

(i) a rail;

(ii) a rail drive mechanism to move said rail perpendicularly to the bending line;

(iii) at least two stops on said rail;

(iv) a releasable clamping mechanism to fix said stops in position on said rail, said stops being movable along said rail upon release of said clamping mechanism; and (v) a clamp locking mechanism for locking said clamping mechanism in a clamp fixing position, said stop assembly being movable into a position in which the stops project over the bending line into the work area of the bending press when said locking mechanism for said actuating device is actuated, said clamp locking mechanism being actuatable to release said clamp locking mechanism when said locking mechanism for said actuating device is actuated to prevent operation of said drive mechanism, whereby said stops may be moved on said rail only when said stops project over said bending line and said locking mechanism is actuated to disable said actuating device and thereby said drive mechanism.

2. A bending press according to claim 1 in which said clamping mechanism includes a clamp which, when actuated, clamps said stop to said rail.

3. A bending press according to claim 2 in which said clamping mechanism includes at least one component which, when actuated, presses against the rail and stop.

4. A bending press according to claim 3 in which said one component is actuated by a source of compressed air.

5. A bending press according to claim 3 in which said one component is actuated by an electromagnet.

6. A bending press according to claim 2 in which said clamp can be changed in its position about said rail by a fluid mechanism.

7. A bending press according to claim 3 in which said component includes an expansible element which, when filled with fluid, expands.

8. A bending press according to claim 1 in which said drive actuating device locking mechanism includes a switch which interrupts the flow of electricity to said drive actuating device.

9. A bending press according to claim 1 in which said locking mechanism for said actuating device for said drive mechanism utilizes electrical power and includes a switch which interrupts the flow of electricity to said actuating device for said drive mechanism.

10. A bending press according to claim 2 in which said clamp locking mechanism includes a release mechanism to release said clamping mechanism and wherein said camping locking mechanism deactivates said release mechanism when said actuating device for said drive mechanism is not disabled.

11. A bending press according to claim 1 in which said clamping mechanism includes a clamp which, when actuated, clamps said stop to said rail and at least one component which, when actuated, presses against said rail and stop, said one component including an expansible element which, when filled with fluid, expands and is a source of compressed air

12. A bending press according to claim 1 in which said clamping mechanism includes a clamp which, when actuated, clamps said stop to said rail said clamping mechanism utilizing electrical power said clamp locking mechanism including a switch which interrupts the flow of electricity to release said clamping mechanism.

13. A bending press for bending workpieces along a bending line and providing a work area in front of the bending line and a stop area behind the bending line, said press comprising:

(a) a drive mechanism for effecting vertical movement of a bending tool;

(b) an actuating device for said drive mechanism;

(c) a locking mechanism for said actuating device to disable its operation;

(d) a locking assembly in the stop area and including:

(i) a rail;

(ii) a rail drive mechanism to move said rail perpendicularly no the bending line;

(iii) at least two stops on said rail;

(iv) a releasable clamping mechanism including a clamp which, when actuated, clamps said stop to said rail, said stops being movable along said rail upon release of said clamping mechanism; and (v) a clamp locking mechanism for locking said clamping mechanism in a clamp fixing position, said clamp locking mechanism includes a release mechanism to release said clamping mechanism, said clamp locking mechanism deactivating said release mechanism when said actuating device for said drive mechanism is not disabled, said stop assembly being movable into a position in which the stops project over the bending line into the work area of the bending press when said locking mechanism for said actuating device is actuated, said clamp locking mechanism being actuatable to release said clamp locking mechanism when said locking mechanism for said actuating device is actuated to prevent operation of said drive mechanism, whereby said stops may be moved on said rail only when said stops project over said bending line and said locking mechanism for said actuating device is actuated to disable said actuation device and said drive mechanism.

14. A bending press according to claim 13 in which said clamping mechanism includes at least one component which, when actuated, presses against the rail and stop.

15. A bending press according to claim 14 in which said one component includes an expansible element which, when filled with fluid, expands and is actuated by a source of compressed air.

16. A bending press according to claim 14 in which said one component is actuated by an electromagnet and said clamp locking mechanism utilizes electrical power and includes a switch which interrupts the flow of electricity to release said clamping mechanism.

* * * * *